US005175471A

United States Patent [19]

Stockinger et al.

[11] Patent Number: 5,175,471

[45] Date of Patent: Dec. 29, 1992

[54] CIRCUIT ARRANGEMENT FOR THE OPERATION OF A FLUORESCENT LAMP

[75] Inventors: Gottfried Stockinger, Eckental; Jurgen Ludwig, Nuremberg, both of Fed. Rep. of Germany

[73] Assignee: Diehl GmbH & Co., Nuremberg, Fed. Rep. of Germany

[21] Appl. No.: 734,611

[22] Filed: Jul. 23, 1991

[30] Foreign Application Priority Data

Aug. 16, 1990 [DE] Fed. Rep. of Germany ..... 4025938

[51] Int. Cl.[5] ..... H05B 39/04

[52] U.S. Cl. ..... 315/107; 315/307; 315/DIG. 5

[58] Field of Search ..... 315/107, 106, 105, 97, 315/94, 194, 209 R, 307, DIG. 5, DIG. 7, DIG. 4; 313/15

[56] References Cited

U.S. PATENT DOCUMENTS

| | | | |
|---|---|---|---|
| 4,051,407 | 9/1977 | Vanderwerf | 315/107 |
| 4,603,281 | 7/1986 | Nilssen | 315/107 |
| 4,746,841 | 5/1988 | Ogawa | 315/107 |
| 4,749,909 | 6/1988 | Smulders | 315/106 |
| 5,027,033 | 6/1991 | Zuchtriegel | 315/106 |
| 5,059,870 | 10/1991 | Choon | 315/106 |

FOREIGN PATENT DOCUMENTS

| | | |
|---|---|---|
| 0111296 | 6/1984 | European Pat. Off. . |
| 3022773 | 1/1981 | Fed. Rep. of Germany . |
| 3327189 | 7/1985 | Fed. Rep. of Germany . |
| 595036 | 1/1978 | Switzerland . |
| WO8502749 | 6/1985 | World Int. Prop. O. . |

*Primary Examiner*—Eugene R. LaRoche
*Assistant Examiner*—A. Zarabian
*Attorney, Agent, or Firm*—Scully, Scott, Murphy & Presser

[57] ABSTRACT

A circuit arrangement for the operation of a fluorescent lamp which is connectable to an alternating-current power supply, for example, the elctrical power supply on board an aircraft, including a switch which is located between the lamp electrodes, and which is actuatable through the intermediary of a control circuit whereby the lamp electrodes are heated when the switch is closed. A measuring element which is connected to the input of the control circuit determines the decreasing voltage at least at one of the lamp electrodes, and the control circuit will open the switch for the ignition of the fluorescent lamp only when the determined voltage is essentially constant, or has reached a threshold value.

9 Claims, 2 Drawing Sheets

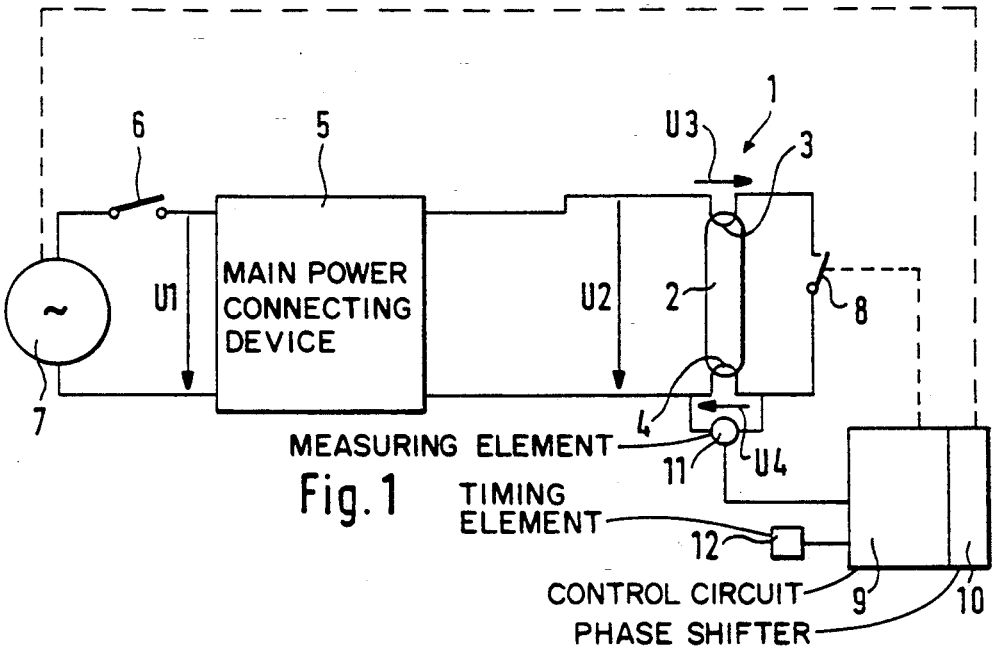
Fig. 1
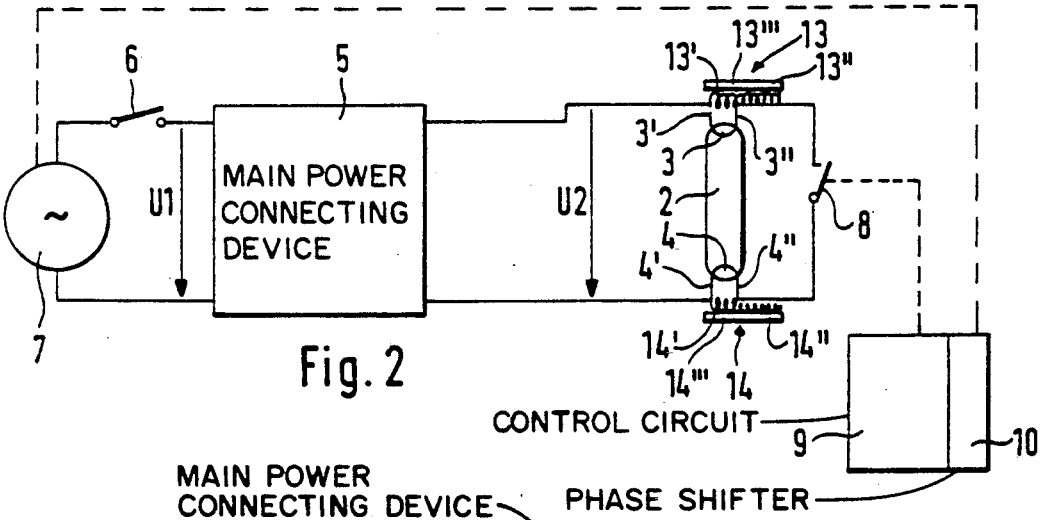
Fig. 2
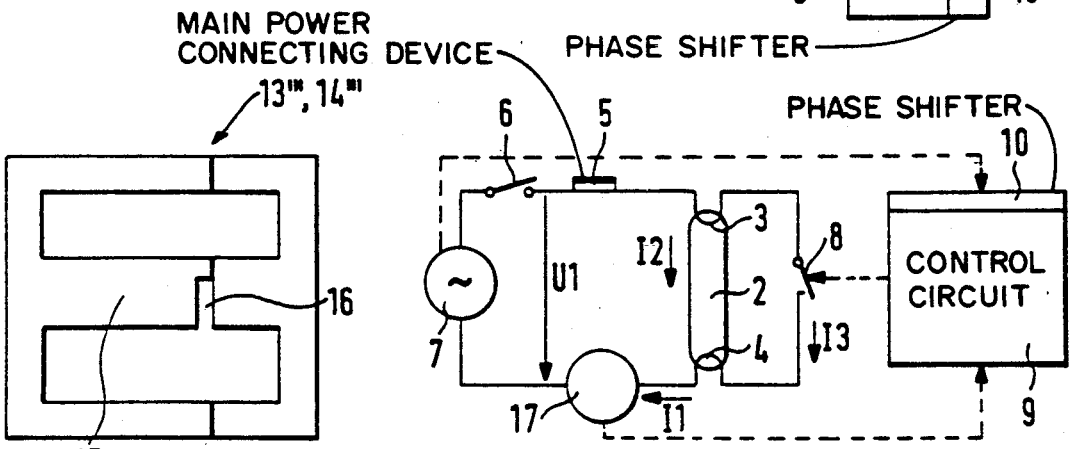
Fig. 3
Fig. 4

CIRCUIT ARRANGEMENT FOR THE OPERATION OF A FLUORESCENT LAMP

BACKGROUND OF THE INVENTION

1. Field of the Invention

The present invention relates to a circuit arrangement for the operation of a fluorescent lamp which is connectable to an alternating-current power supply, for example, the electrical power supply on board an aircraft, including a switch which is located between the lamp electrodes, and which is actuatable through the intermediary of a control circuit whereby the lamp electrodes are heated when the switch is closed.

2. Discussion of the Prior Art

A circuit arrangement of the type mentioned hereinabove is described in German Laid-Open Patent Appln. 33 27 189 A1. The control circuit serves for a dimming of the brightness. Through the opening of the switch, the control circuit generates phase-shifted ignition voltage pulses during each half-wave of the power supply. In the presence of a closed switch, a heating current flows across the lamp electrodes. The ignition voltage pulses are immediately generated during each half-wave of the power supply upon the opening of a power supply switch. Ignition voltage pulses consequently are produced even when the lamp electrodes are not yet adequately preheated.

It has been evidenced that the duration of the working order of a fluorescent lamp and in the life expectancy thereof will be significantly shortened, when attempts at ignition are carried out while the lamp electrodes are still cold. In the circuit arrangement pursuant to German OS 33 27 189 A1 there are produced numerous ignition pulses with lamp electrodes which are still not adequately heated, so that there must only be expected a short life expectancy for the fluorescent lamp.

In the disclosure of Swiss Patent 595,036 there is similarly described a circuit arrangement of the above-mentioned type. In this publication there is mentioned that in the dark control of the fluorescent lamps, through the preheating of the lamp electrodes subsequent to the switching on of the fluorescent lamps, there is avoided a cold-start. However, the manner in which this dark control is implemented is not disclosed.

SUMMARY OF THE INVENTION

Accordingly, it is an object of the present invention to propose the provision of a circuit arrangement of the above-mentioned type, with the use of which the life expectancy of the fluorescent lamp is automatically extended.

Inventively, the above-mentioned object is achieved through the intermediary of a circuit arrangement of the above-mentioned type in that a measuring element which is connected to the input of the control circuit determines the decreasing voltage at least at one of the lamp electrodes, and the control circuit will open the switch for the ignition of the fluorescent lamp only when the determined voltage is essentially constant, or has reached a threshold value.

Hereby, the invention renders itself useful in that the lamp electrodes evidence a positive temperature coefficient. In that case, the ohmic resistance of the lamp electrodes rises from the cold condition to the preheated condition; for example, by a factor of 4.

When a power supply switch is closed for initiating the operation of the fluorescent lamp, then the switch which connects the lamp electrodes remains initially closed such that a heating current flows across the lamp electrodes. With an increasing heating up of the lamp electrodes, there rises the voltage which is determined or picked up by the measuring element. When this voltage no longer changes or has reached a predetermined threshold value, then the lamp electrodes are sufficiently preheated. Only then will the control circuit ignite the fluorescent lamp. Consequently, attempts at ignition are avoided during the preheating period. As a result thereof, there significantly increases the life expectancy of the fluorescent lamp. The preheating period, as a rule, will be essentially lengthier in time beginning from cold condition of the fluorescent lamp, than a half-wave of the alternating current power supply voltage.

It is also expedient that the respective preheating period is proportional to the cooling of the lamp electrodes which occurs upon the switching off of the fluorescent lamps. When the fluorescent lamp was switched off for only a short period of time prior to a renewed activation thereof, then the preheating period is inherently shorter than would be the case when the fluorescent lamps were prior thereto switched off for a lengthier period of time, and as a result, the lamp electrodes were more considerably cooled down.

Expedient in the evaluation or determination of the temperature-dependent voltage of the lamp electrodes is also that, when the lamp electrodes do not cool down extensively due to the temperature of the surroundings, the following heating period becomes applicably short.

Attained through the invention is that the necessary preheating of the lamp electrodes is achieved prior to an ignition attempt, and automatically all encountered cooling effects are considered, whereby in an individual instance there is presently obtained a correspondingly short preheating period.

Pursuant to an embodiment of the invention, the control circuit closes the switch for the heating of the electrodes when there is a change in the voltage which is determined by the measuring electrode changes, or when it falls below the threshold value. As a result thereof, achieved thereby is that in the presence of cold lamp electrodes there is spontaneously initiated the commencement of a preheating period.

In another embodiment of the invention, there is provided a timing element which restricts the preheating time to a maximum value. In view thereof, this will achieve that, in every instance, there is prevented any overheating of the lamp electrodes.

For a circuit arrangement of the above-mentioned type a second solution in implementing the foregoing object distinguishes itself in that a transformer is provided for at least one of the lamp electrodes, the primary winding of the transformer being connected in series with the switch, and to the secondary side of which there is connected the lamp electrode such as to increase the preheating current which flows in the presence of the closed switch.

Also through this solution is there extended the life expectancy of the fluorescent lamp. In actual practice, the lamp electrodes are subject scattering effects which are specific to the manufacture thereof and patterns in scattering effects by the ohmic resistances of the lamp electrodes. At conditions of the same preheating current which is delivered by a main connecting device, and for the same preheating period, the different fluorescent lamps are then differently preheated. When the main connecting device for lamps with a high-ohmic resistance delivers a sufficient preheating current, then with lamps with lower-ohmic lamp electrodes, this not to lead a desired preheating. Consequently, this can lead to lamp starting attempts with insufficiently heated electrodes. This would considerably reduce the life expectancy of the applicable fluorescent lamps. The foregoing condition is avoided through the presence of the transformer. This is because, in view of the presence of the transformer, with the switch closed the current for the lamp electrodes flowing at the primary side will be intensified.

Preferably, the transformer possesses a nonlinear core, so that for lower-ohmic lamp electrodes, this results in a higher current intensification on the secondary side than for high-ohmic lamp electrodes.

Hereby, it is also expedient that there are avoided high magnetic reversal losses of the core. As a result thereof, the transformer is heated to a lesser extent than for high magnetic reversal losses.

For a circuit arrangement of the above-mentioned type whereby the control circuit during dimmed operation, periodically opens the switch at phase-shifted ignition timepoints, a third solution of the above-mentioned object distinguishes itself in that a measuring element which is connected to the control circuit determines the operating voltage; in essence, the reactive or impedance current during dimmed operation, and upon a falling below or exceeding a limiting value or threshold for the operating current or; in essence the impedance current, the control circuit displaces or shifts the ignition timepoints.

Consequently, the life expectancy of the fluorescent lamps is extended. The foregoing is due to the aspect that a lowering of the operating voltage necessarily leads to a reduction in the lamp current. This results in a cooling down of the lamp electrodes. Hereby, this presents the danger that the emission layers of the lamp electrodes may be damaged or destroyed. By means of the present invention, the foregoing is avoided, inasmuch as upon a lowering of the operating voltage, the control circuit increases the heating current. In effect, there is thus counteracted the cooling down of the lamp electrodes which is due to the lowered operating voltage. The life expectancy of the fluorescent lamp is thereby increased. The same is applicable to impermissably high operating voltages.

A fourth solution for attaining the above-mentioned object in a circuit arrangement of the above-mentioned type distinguishes itself in that a voltage indicator monitors the operating voltage, and that in the presence of voltage deviations or fluctuation which conceivably could damage a main connecting device or the fluorescent lamps, by means of a further switch the voltage indicator will switch off the main connecting device and the fluorescent lamp.

Preferably, this further switch consists of a semiconductor switch. It is preferably activated in the voltageless condition and switched-off at passage of the current through zero.

The hereinabove described circuit arrangements individually each meet the foregoing object. An improved solution of the inventive object can be attained when the circuit arrangements are utilized in combination with each other.

BRIEF DESCRIPTION OF THE DRAWINGS

Advantageous embodiments and features may now be more readily ascertained from the following detailed description of preferred embodiments of the invention, taken in conjunction with the accompanying drawings; in which:

FIG. 1 illustrates a block circuit diagram of a circuit for a fluorescent lamp to guard against a coldstart;

FIG. 2 illustrates a block circuit diagram for a fluorescent lamp shown with transformers connected to the lamp electrodes;

FIG. 3 illustrates a core of a transformer pursuant to FIG. 2;

FIG. 4 illustrates a circuit for a fluorescent lamp with a monitoring of the operating voltage;

DETAILED DESCRIPTION

Figure 5:
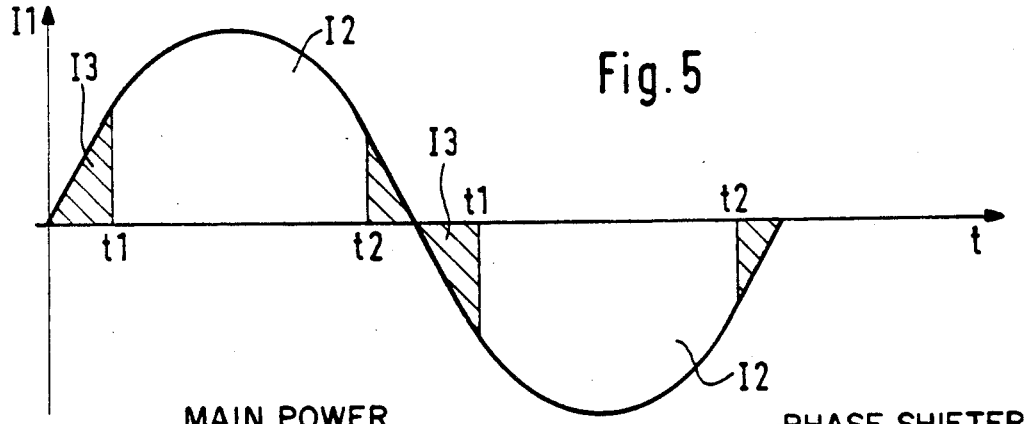
FIG. 5 illustrates a plot of the voltage.

A fluorescent lamp 1 possesses a fluorescent tube 2 with two lamp electrodes 3, 4. The lamp electrodes 3, 4 are connected to an alternating-current voltage source 7; for example, an electrical power supply on board an aircraft, through either a passive or active main power connecting device 5 and a power supply switch 6. In the exemplary embodiments pursuant to FIGS. 4 and 6, the passive main power connecting device is formed by an impedance 5.

The poles of the electrodes 3, 4 which are distant from the alternating-current voltage supply 7, are interconnected through a switch 8. This switch is actuated by a control circuit 9.

By means of the control circuit 9 it is possible to effectuate a brightness control for the fluorescent lamp 1 (dimmed operation) in a known manner. For this purpose, the control circuit 9 possesses a phase-shifter 10, and during every half-wave of the alternating-current voltage, opens the switch 8 more or less phase-shifted with respect to passage through zero. This switching frequency need not possess twice the power supply frequency. It can also be at the power supply frequency, or be a multiple thereof or a fraction thereof. Through the opening of the switch 8 there is produced an ignition pulse which ignites the fluorescent tube 2 (referring to ignition timepoints t1 in FIG. 5). Thereafter there flows the heating current or; in essence, the lamp current.

As long as the power supply switch 6 and the switch 8 are closed, a heating current flows across the lamp electrodes 3, 4.

Connected to the control circuit 9 is a measuring element 11 (referring to FIG. 1). This determines the falling voltage U4 at the lamp electrode 4. The measuring element 11 can also be connected in such a manner as to be able to determine the falling voltage U3 at the lamp electrode 3. It can also be so connected as to be to determine the voltage U2, which is the sum of the voltages U3 and U4 and the voltage falling off at the switch 8. The ohmic resistance of the lamp electrodes 3, 4 possesses a positive temperature coefficient. As long as the lamp electrodes 3, 4 are comparatively cold inasmuch as; for example, the illumination was switched-off through the opening of the power supply switch 6, or the operating voltage U1 had an outage for a short time, or the fluorescent lamp 1 was changed, then the ohmic resistance of the lamp electrodes 3, 4 is substantially lower than during operation.

The mode of operation of the above-described circuit is generally as follows:

When the power supply switch 6 is closed for the energizing of the lamp electrodes 3, 4, a heating current then flows across the lamp electrodes 3, 4 and the switch 8. The control circuit 9 ascertains the voltage which drops off at the measuring element 11 and, as a result thereof, maintains the switch 8 closed. In essence, it is not synchronized in conformance with the power supply frequency.

Due to the heating current which flows, the lamp electrodes 3, 4 heat up gradually and the voltage 4 changes correspondingly. During this period of time no ignition attempts are undertaken through an opening of the switch 8.

When the lamp electrodes 3, 4 have reached their operating voltage, then the voltage U4 no longer changes, but remains essentially constant. This is evaluated by the control circuit 9, and now first periodically opens the switch 8.

Instead of evaluating the changes in the voltage U4, there can also be provided an evaluation of the reaching of a threshold for the voltage U4. The threshold; in this instance; is set in the control circuit 9. Only then, when the threshold value has been reached; in effect, and the lamp electrodes 3, 4 have been heated to an adequate temperature, will the control circuit periodically actuate the switch 8 in timed operation.

In both instances there be additionally be provided a timing element 12. This timing element limits the preheating period to a maximum value. The foregoing facilitates that the lamp electrodes 3, 4 will not be overheated.

The preheating of the lamp electrodes 3, 4 prior to the switching of the switch 8 at the power supply frequency provides the advantage that the life expectancy of each of the lamp electrodes 3, 4 is significantly increased, inasmuch as cold-starting attempts are inhibited.

In the embodiment pursuant to FIG. 2, the components which correspond with those in FIG. 1 are identified by the same reference numerals.

A transformer 13 is connected to with its secondary side to the two poles 3', 3'' of the lamp electrode 3. A transformer 14 has the secondary side thereof connected to the two poles 4', 4'' of the lamp electrode 4. The transformers 13, 14 are constructed as auto or "economy transformers", whereby a winding portion 13' or respectively 14' of the primary winding 13'' or, respectively, 14'' forms the secondary winding. The primary windings 13'', or respectively, 14'' are connected in series with the switch 8.

The current which flows through the primary windings 13'', 14'' in the presence of a closed power supply switch and closed switch 8 is stepped-up to a higher level so that correspondingly higher current flows through the lamp electrodes 3, 4. As a result thereof, attained thereby is that the preheating period which is described with respect to FIG. 1 is shortened.

In particular, when the ohmic resistances of the lamp electrodes 3, 4 are lower than that which is contemplated in accordance to the design of the main connecting device 5, there is achieved that the lower-ohmic lamp electrodes 3, 4 are preheated with a high-transformed or stepped-up current. This prevents that any cold-starting attempts will be carried at the lower-ohmic, not yet adequately preheated lamp electrodes 3, 4. The life expectancy of the latter is thereby considerably increased.

The transformers 13, 14 are each provided with a magnetic core 13''' or, respectively, 14''' as shown in FIG. 3. Preferably, the core is constructed non-linearly in that it possesses an arm or limb 15 of a considerably reduced magnetic cross-section. This structure is illustrated in FIG. 3 in the form of a partial gap 16.

There is resultingly obtained that, for lower ohmic lamp electrodes 3, 4, due to the primary inductivity of the transformer there flows only a lower magnetizing current which will not overexcite the core. In contrast therewith, for high-ohmic lamp electrodes 3, 4, in consequence of the impressed current, thee is produced a higher current in the winding. This reduces the effective primary inductivity. The secondary current will then only slightly increase.

Due to the non-linear core, there is thus achieved in an advantageous manner that in lower-ohmic lamp electrodes there is encountered a strong increase in the heating current, whereas contrastingly, in high-ohmic electrodes, the heating current increases only slightly. Simultaneously, there is also achieved that there are avoided high magnetic reversal losses which could conceivably lead to a significant increase in the temperature of the transformers.

The circuit in accordance with FIG. 2 also allows such fluorescent lamps (rapid-start lamps) to be employed which require a higher heating current than other fluorescent lamps (starter lamps).

The circuit features set forth pursuant to FIGS. 1 and 2 can be employed in common within a circuit arrangement. The measurement of the voltage U4 can then take place intermediate the poles 4' and 4''. The measurement can also be carried out on the primary winding 14''. The same is applicable to the voltage U3. In this instance there can also be contemplated a measurement of the voltage U2.

When the control circuit 9 is designed in such a manner that during dimmed operation the switch 8 will be actuated not during each half-wave of the power supply voltage, but only during either positive or negative half-waves, then it can be sufficient to provide only one of the transformers 13, 14.

Figure 6:
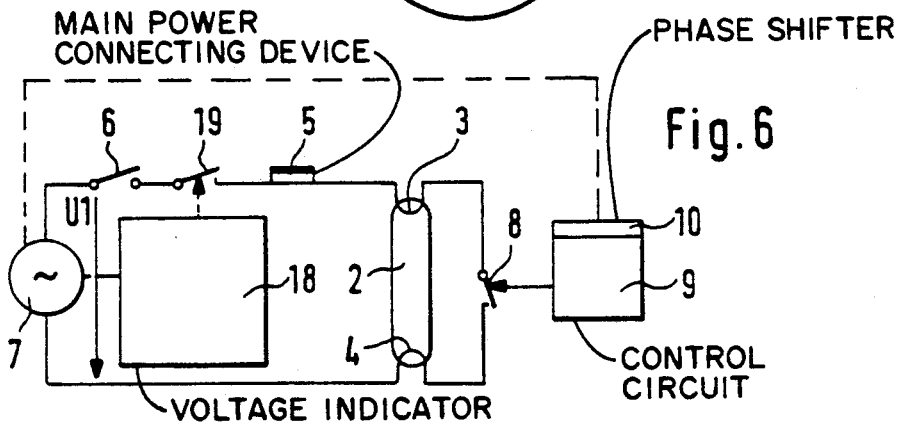
FIG. 6 illustrates a circuit of a fluorescent lamp with an auxiliary switch.

Also in the embodiments pursuant to FIGS. 4 and 6 are the components which correspond with those in FIG. 4 identified by the same reference numerals.

In the embodiment pursuant to FIG. 4, a measuring element 17 is present and which is connected to the control circuit 9. When the operating voltage U1 falls off, the impedance current I1 thereby reduces and consequently, also the heating current 13 which flows during dimmed operation with each half-wave of the power supply, and which is limited through the switching timepoints t1, t2 which are controlled by the control circuit 9 (as shown in FIG. 5). As a result thereof, this can lead to an undesired cooling down of the lamp electrodes 3, 4, whereby the life expectancy of the fluorescent lamp 1 can be shortened due to this cooling action.

The measuring element 17 measures the impedance or relative current I1. The latter is compared in the control circuit 9 with a reference value. In dependence upon this comparison, there can be displaced the switching timepoints t1 and, respectively t2, permit themselves to be sifted. When the heating current 13 has fallen off to such a level that it will heat the lamp electrodes 3, 4, only to an inadequate degree; in effect, cooling the lamp electrodes, then the ignition timepoints t1 are displaced or shifted in the direction of the maximum current; in essence, towards the right in FIG. 5. As a result thereof, there is raised the peak value of the heating current 13. This is thereafter also coupled with an increase in the duration of the heating current. From the foregoing, there can be produced a reduction in the brightness of the fluorescent lamp 1, inasmuch as the duration of the operating current I2 is shortened. In order to avoid this condition, then within controlled boundaries, the timepoints t2 at which the switch 8 is closed; in effect, at which the operating current I2 terminates and the heating current I3 commences, can be shifted in a direction towards a subsequent passage through zero of the current; in essence, towards the right in FIG. 5.

Conversely, even at an increase in the operating voltage U1 can there be avoided a rise in the impedance current I1 which could similarly lead to a damaging of the lamp electrodes 3, 4. For this purpose, the ignition timepoints t1 and, respectively, t2 are corresponding shifted towards the left in FIG. 5.

The additional measuring element 17 pursuant to FIG. 4 also allows itself to be incorporated in a circuit arrangement which provides for the features of the circuit arrangement pursuant to FIGS. 1 and/or 2.

In the exemplary embodiment pursuant to FIG. 6 there is provided a voltage indicator 18 for the operating voltage U1 of the alternating-current voltage source 7. This component controls a further switch 19 which is connected in series with the power supply switch 6.

The voltage indicator 18 is designed in such a manner that, in the presence of excess voltages or under-voltages of the operating voltage U1, it opens the switch 19 and then again closes the switch when either the excess voltage or the under-voltage is no longer present. As a result, there is achieved that such excess or undervoltages are switched so as to be ineffective, which could have damaged the main connecting device 5 or the fluorescent lamp 1.

The further switch 19 consists of a semiconductor switch which withstands at least the maximum permissible operating voltage U1. Preferably, the voltage indicator 16 is designed such that it will switch on the switch 19 in the voltageless condition and switch off the switch in the currentless condition.

Also the circuit arrangement shown in FIG. 6 allows the integration thereof into one or more of the circuits shown in FIGS. 1 and/or FIG. 2 and/or FIG. 4.

Figure 7:
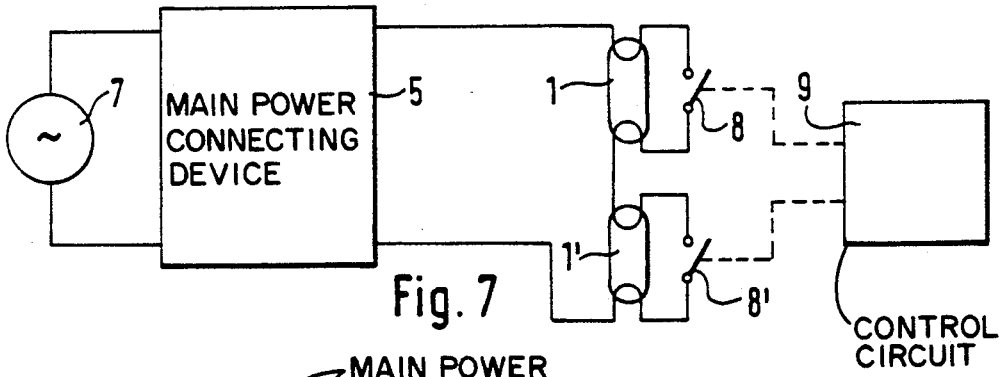
FIGS. 7 and 8 illustrate, respectively, circuits each containing more than one fluorescent lamp.

The hereinabove described circuit arrangements can also allow themselves to be employed when two or more fluorescent lamps are connected with each other. In accordance with FIG. 7, two fluorescent lamps 1, 1' are connected in series with a single main connecting device 5. In this case, only a single control circuit 9 is required for the two switches 8, 8'. It is sufficient that the measuring element 11 be located on one of the lamp electrodes 3, 4, 3', 4'. Upon occasion, only one measuring element 17 may be required.

Figure 8:
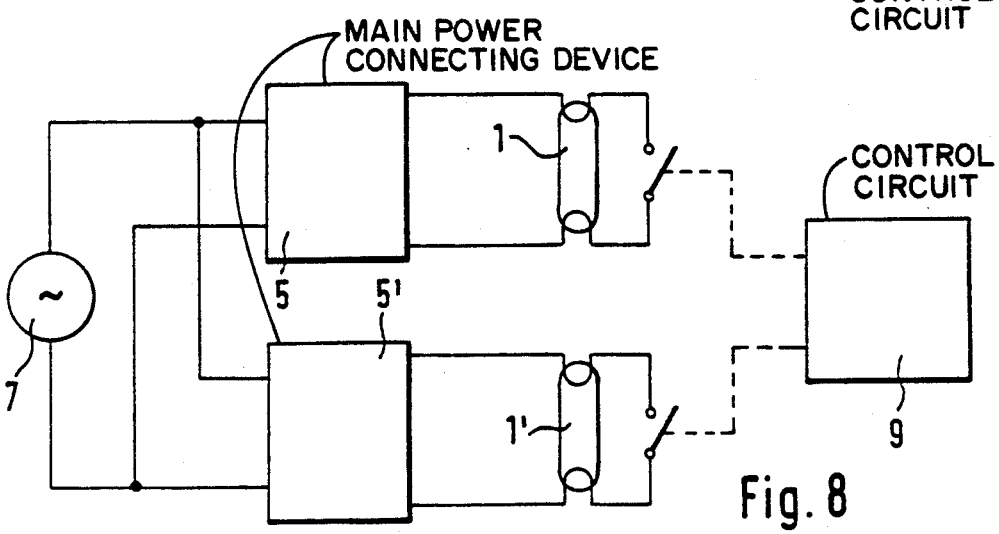

According to FIG. 8, the main connecting devices 5, for the fluorescent lamps 1, 2' are connected in parallel with the alternating-current voltage source 7. Also in this instance is there required only a single control circuit 9 for the two switches 8, 8', to which circuit there are connected the measuring elements 11 and/or 17.

What is claimed is:

1. Circuit arrangement for the operation of a fluorescent lamp which is connected to an alternating-current power supply, such as an electrical power supply on board aircraft; including a switch connected between lamp electrodes of said fluorescent lamp; a control circuit for actuating said switch, said lamp electrodes being heated responsive to closing of said switch and said control circuit periodically actuating said switch for connecting said switch to the power supply so that effect dimming of the lamp; a measuring element being connected to an input of the control circuit for determining a voltage drop off at least at one of the lamp electrodes and in which the control circuit maintains said switch in a closed condition as long as the voltage determined at said at least one lamp electrode varies or has not reached a specified threshold value and opens the switch for ignition of the fluorescent lamp only when the voltage at said at least one lamp electrode is essentially constant or has reached said threshold value.

2. A circuit arrangement as claimed in claim 1, wherein the control circuit closes the switch for a heating of the lamp electrodes when the voltage determined by said measuring element changes or falls below the threshold value.

3. A circuit arrangement as claimed in claim 2, wherein a preheating period during which the measuring element causes the control circuit to maintain the switch in a closed condition extends over a plurality of half-waves of the alternating-current power supply.

4. A circuit arrangement as claimed in claim 3, wherein a timing element limits the preheating period to a maximum value.

5. A circuit arrangement as claimed in claim 1, wherein a transformer is included for at least one of the lamp electrodes, said transformer having a primary winding connected in series with the switch and having the lamp electrode connected to a secondary winding thereof so increases the preheating current flowing in the closed condition of the switch.

6. A circuit arrangement as claimed in claim 5, wherein the transformer comprises a single winding forming the secondary winding and the primary winding.

7. A circuit arrangement as claimed in claim 5, wherein the transformer comprises a non-linear core such that for lower ohmic lamp electrodes the secondary winding side encounters a higher current intensification than for high-ohmic lamp electrodes.

8. A circuit arrangement as claimed in claim 1, wherein the control circuit periodically opens the switch at phase-shifted switching timepoints during dimmed operation, said measuring element being connected to the control circuit and during the dimmed operation determining the operating voltage or an impedance current, and upon the dropping below or exceeding of a threshold value for the operating current or impedance current, said control circuit shifts the switching timepoints of said switch.

9. A circuit arrangement as claimed in claim 1, wherein a voltage indicator monitors the operating voltage such that in the presence of voltage deviations potentially damaging to a main connecting means or to the fluorescent lamp, said voltage indicator causes a further switch to switch off the main connecting means and the fluorescent lamp.

* * * * *